US006171148B1

(12) United States Patent
Chiu et al.

(10) Patent No.: US 6,171,148 B1
(45) Date of Patent: Jan. 9, 2001

(54) ELECTRICAL POWER CONNECTOR

(75) Inventors: Allen Chiu; Jerry Wu, both of Tu-Chen (TW)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/327,944

(22) Filed: Jun. 8, 1999

(30) Foreign Application Priority Data

Sep. 22, 1998 (TW) ..... 87215727

(51) Int. Cl.[7] ..... H01R 13/648
(52) U.S. Cl. ..... 439/607
(58) Field of Search ..... 439/79, 83, 567, 439/607, 609

(56) References Cited

U.S. PATENT DOCUMENTS 5,842,886 * 12/1998 Illg et al. ..... 439/607
5,951,335 * 9/1999 Kurotori et al. ..... 439/733.1
5,989,040 * 11/1999 Nishimatsu ..... 439/79
6,000,953 * 12/1999 Quillet et al. ..... 439/79
6,000,968 * 12/1999 Hagiwara ..... 439/607

* cited by examiner

*Primary Examiner*—Khiem Nguyen
(74) *Attorney, Agent, or Firm*—Wei Te Chung

(57) ABSTRACT

An electrical power connector includes a nonconductive housing defining a central channel and two side channels on opposite sides of the central channel. The central channel has an inner step formed on an upper inside surface thereof. The side channels each have an inner step formed on a lower inside surface thereof. A Z-shaped conductor is received in each of the channels. An inner shoulder of the conductor is disposed against the inner step of the corresponding channel and an outer shoulder of the conductor is substantially flush with a rear face of the housing. The conductors in the central and side channels are inverted with respect to each other thus soldering sections thereof are coplanar and surface mountable to a circuit board. The housing is supported against an edge of the circuit board whereby a lower portion thereof is positioned below the circuit board and supported by the surface mounted conductors. The circuit board edge abuts against the outer shoulders of the second conductors. Two side wings extend from the housing and are supported on the circuit board.

15 Claims, 6 Drawing Sheets

ELECTRICAL POWER CONNECTOR

BACKGROUND OF THE INVENTION

1. Field of the Invention

The present invention generally relates to an electrical power connector, and in particular to a power connector surface mountable to a circuit board.

2. The Prior Art

The connection of a circuit board to a power supply cable may be achieved by means of an electrical power connector fixed on the circuit board for receiving a mating connector of the power supply cable. Conventionally, the power connector is mounted to the circuit board by means of a through hole technique, namely free ends of conductors of the connector extend through holes formed on the circuit board and are then soldered thereto as seen in FIG. 1 of the attached drawings.

The connector 60 comprises a nonconductive housing 62 having a plurality of conductors 64 arranged therein. Free ends 66 of the conductors 64 extend through holes (not labeled) defined in a circuit board 68 and then solder 70 is applied thereto. The through hole technique renders the connector 60 to be unable to withstand forces acting thereupon when connecting/disconnecting with a mating connector of the power supply cable. Pertinent examples are disclosed in Taiwan Patent Application No. 79208184 and U.S. Pat. No. 4,640,566. In addition, the housing 62 of the connector 60 is located entirely above the circuit board 68 thereby occupying a significant space on the circuit board which is disadvantageous for devices that require a strict conservation of space, such as notebook computers.

Furthermore, since conductors of a power connector are positioned in a triangle arrangement, the conductors are shaped differently to suit such an arrangement,. Thus, manufacturing costs are increased It is thus desirable to have an electrical power connector that overcomes the problems discussed above.

SUMMARY OF THE INVENTION

Accordingly, an object of the present invention is to provide an electrical power connector having conductors arranged with free ends thereof substantially coplanar and surface mountable to a circuit board and a lower portion located below the circuit board thereby reducing the space occupied by the connector on the circuit board.

Another object of the present invention is to provide an electrical power connector supported against an edge of a circuit board wherein the connector comprises two side wings supported on the circuit board thereby securely fixing the connector to the circuit board and withstanding forces applied thereto from connection/disconnection with a mating connector.

A further object of the present invention is to provide an electrical power connector having substantially identical conductors arranged in two groups and inverted with respect to each other whereby free ends thereof to be surface mounted to the circuit board are coplanar.

To achieve the above objects, an electrical power connector in accordance with the present invention comprises a nonconductive housing defining a central channel and two side channels on opposite sides of the central channel. The central channel has an inner step formed on an upper inside surface thereof. The side channels each have an inner step formed on a lower inside surface thereof. A conductor is received in each of the channels. The conductor has a mating section and a soldering section parallel to and offset from each other. The mating section and the soldering section are connected together by a connection section thereby forming a Z-shaped configuration having an inner shoulder and an outer shoulder. The inner shoulder is disposed against the inner step of the corresponding channel and the outer shoulder is substantially flush with a rear face of the housing beyond which the soldering section extends. The conductors in the central and side channels are inverted with respect to each other thus the soldering sections are coplanar and surface mountable to a circuit board. The housing is supported against an edge of the circuit board whereby a lower portion thereof is positioned below the circuit board and is supported by the surface mounted conductors. The circuit board edge abuts against the outer shoulders of the second conductors. Two side wings extend from the housing and are supported on the circuit board. A U-shaped metal shield member is selectively fit over the housing. The shield member has two outer extensions surface mounted to the circuit board.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENTS

Figure 1:
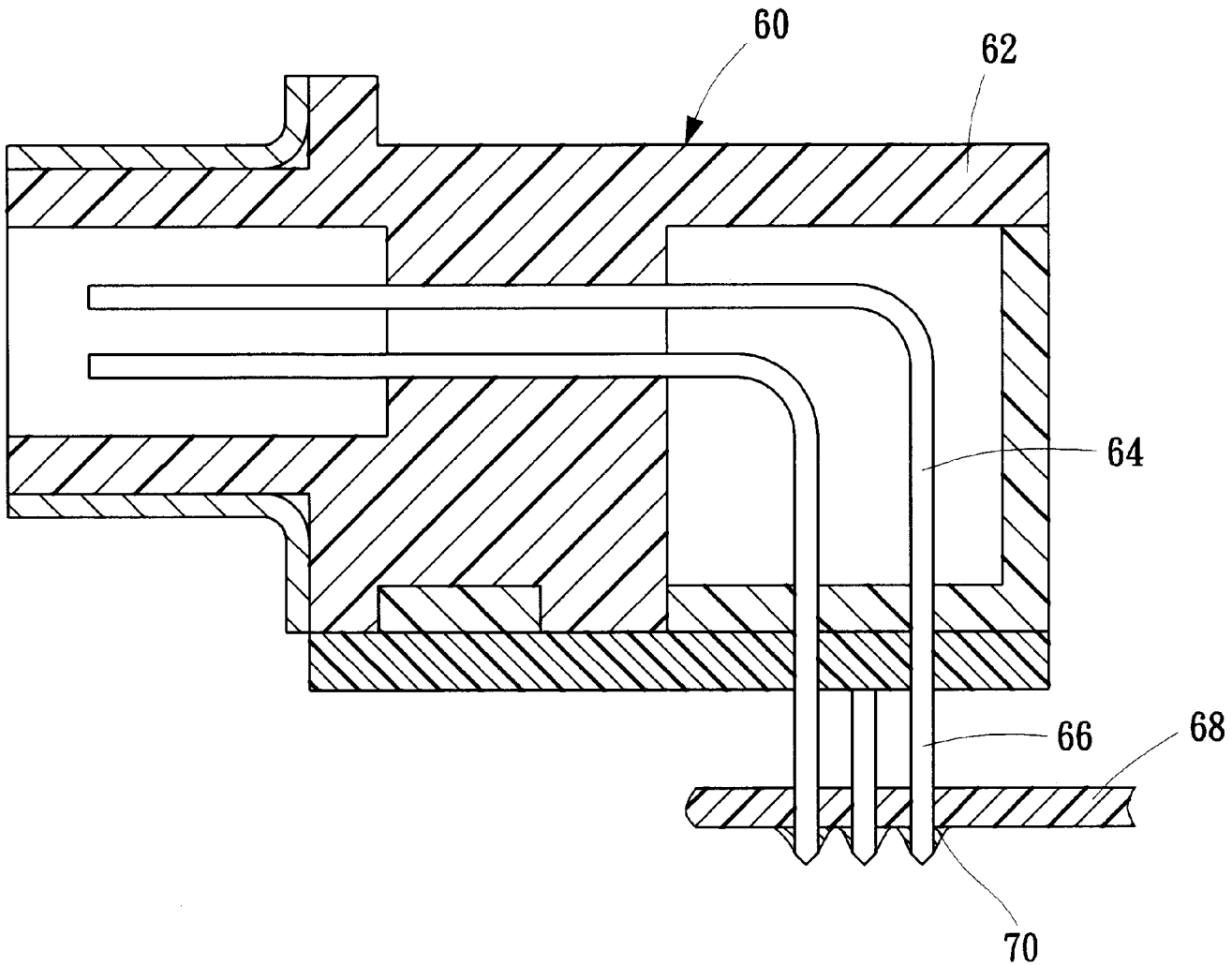
FIG. 1 PRIOR ART
FIG. 1 is a cross sectional view of a prior art power connector.
Figure 2:
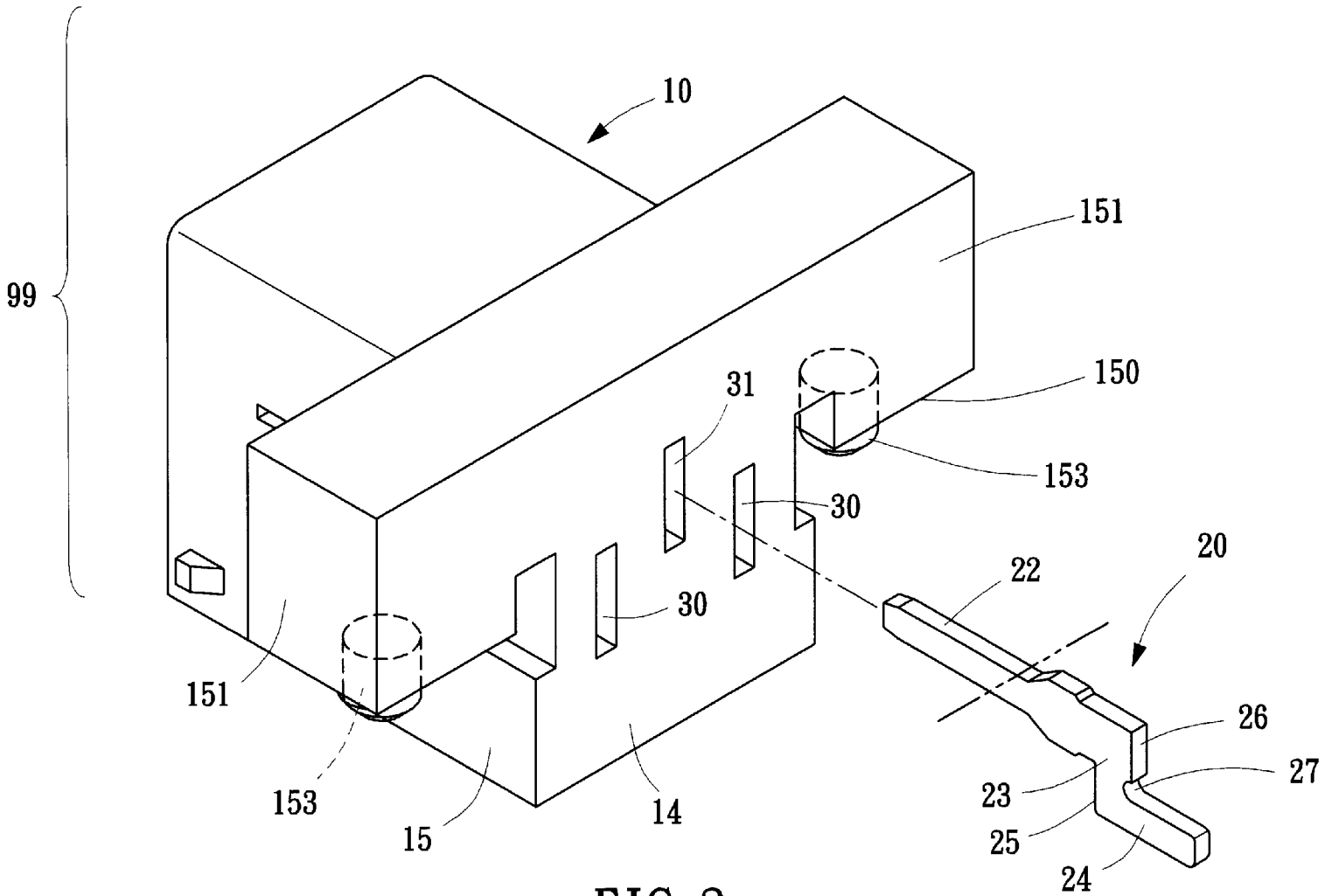
FIG. 2 is a perspective view of an electrical power connector in accordance with the present invention with conductors (only one shown) detached and a metal shield removed therefrom.
Figure 3:
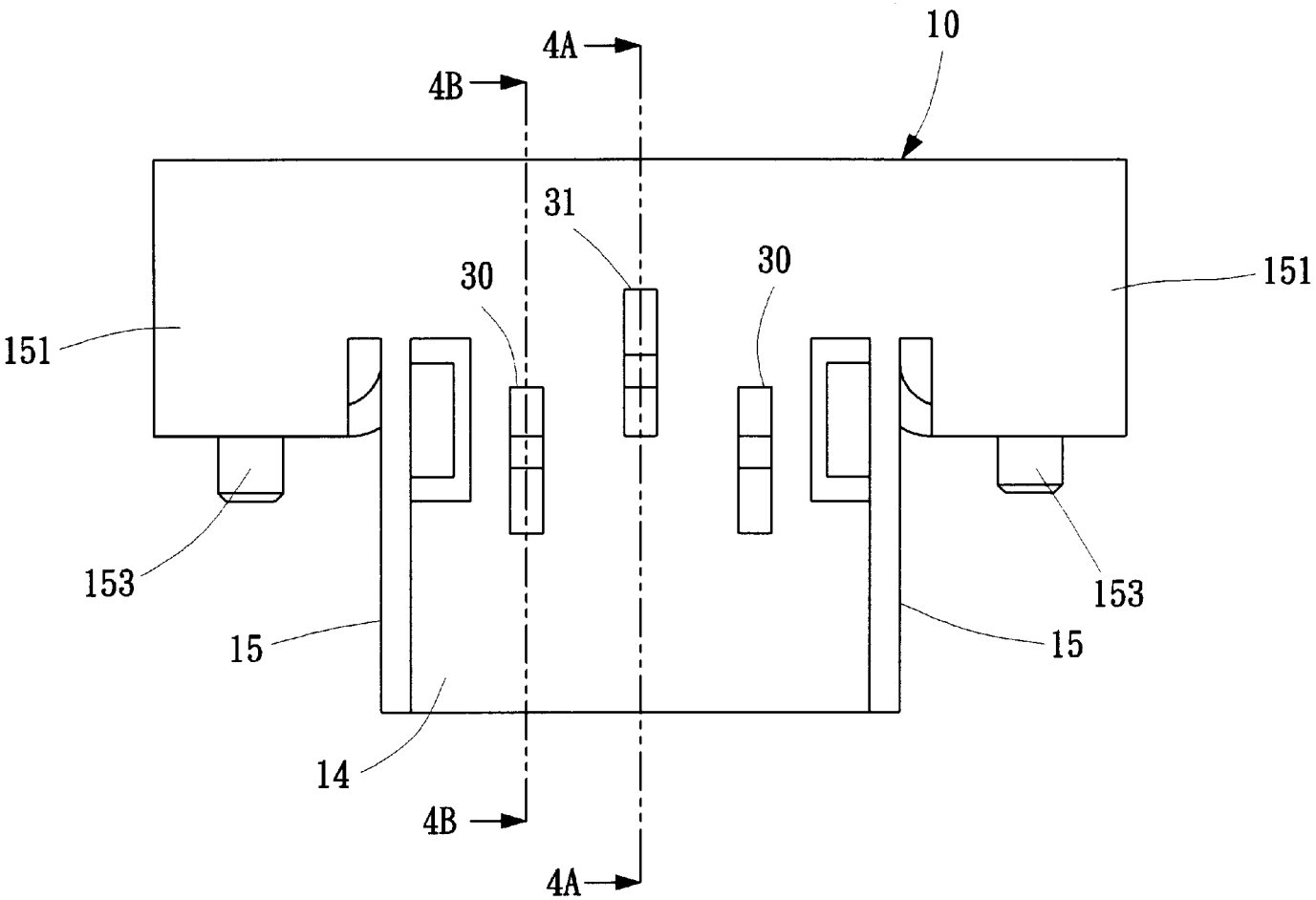
FIG. 3 is a rear end view of the electrical power connector illustrating the arrangement of the conductor receiving channels.
Figure 4B:
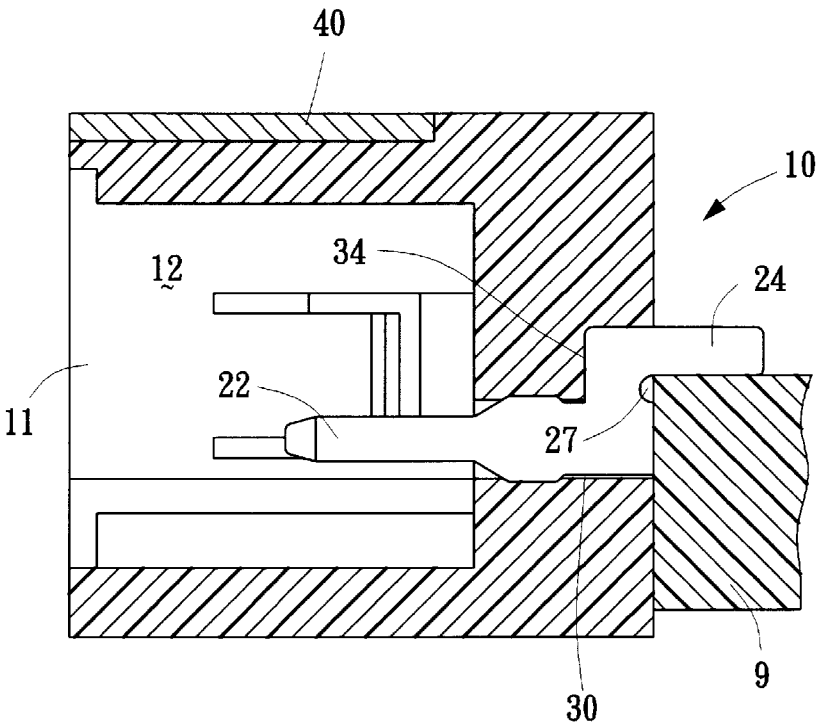
FIG. 4B is a cross sectional view taken along line 4B—4B of FIG. 3 showing the spatial relationship between the housing and the side conductors.
Figure 4A:
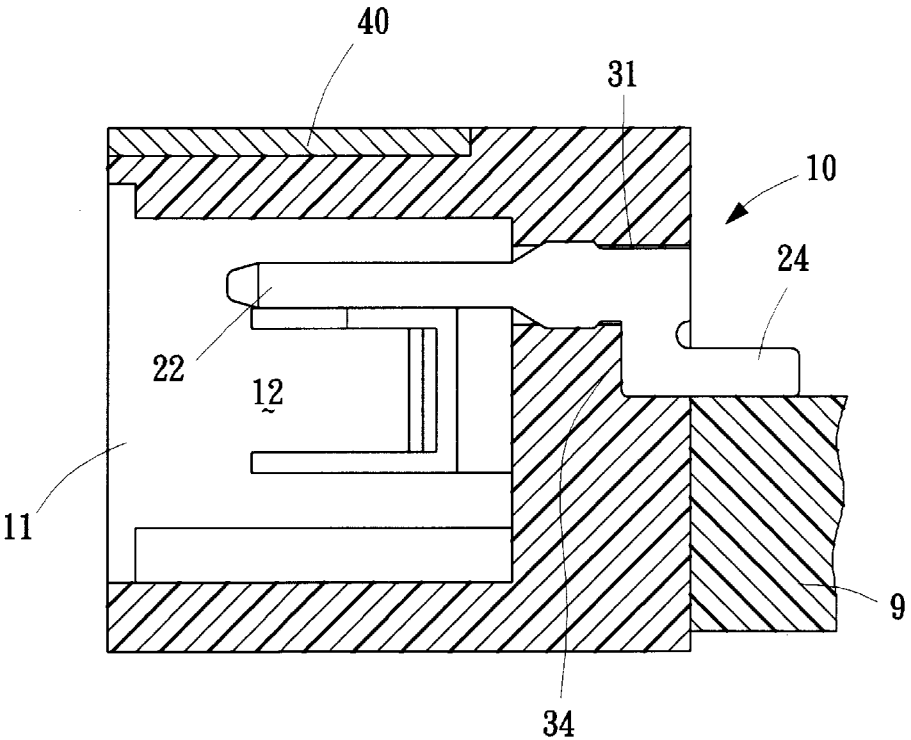
FIG. 4A is a cross sectional view taken along line 4A—4A of FIG. 3 showing the spatial relationship between the housing and the central conductor.

Referring to the drawings and in particular to FIG. 2, wherein an electrical power connector constructed in accordance with the present invention, generally designated by reference numeral 99, is shown, the electrical power connector 99 comprises a nonconductive housing 10 having an open front face 11 defining a receptacle chamber 12 (FIGS. 4A and 4B) for receiving a mating connector (not shown) and an opposite rear face 14 in which a plurality of channels 31, 30 are disposed in communication with the receptacle chamber 12. In the embodiment illustrated, a central channel 31 and two side channels 30 are disposed in the rear side face 14 of the housing 10.

The housing 10 comprises two side wings 151 transversely extending from the housing 10. Each side wing 151 has a bottom face 150 on which a positioning post 153 is provided. The bottom face 150 is adapted to be positioned on a circuit board 9 (FIG. 6) to support the electrical power connector 99 thereon whereby the positioning posts 153 are received in corresponding openings (not labeled) defined in the circuit board 99 to properly position the housing 10 thereon.

Each channel 30, 31 receives a conductor 20 therein. The conductor 20 has a Z-shaped configuration, comprising a mating section 22 and a soldering section 24 parallel to but offset from each other. The mating section 22 and the soldering section 24 are connected to each other by means of a connection section 23 which is substantially normal to the mating section 22 and the soldering section 24 thereby forming a first (inner) shoulder 25 and a second (outer) shoulder 26 with the soldering section 24 and the mating section 22, respectively.

Each conductor 20 is arranged in the housing 10 with the connection section 35 received in the corresponding channel 30, 31, the soldering section 24 extending beyond the rear face 14 for soldering to the circuit board 9, and the mating section 22 extending into the receptacle chamber 12. Each channel 30, 31 forms an inner step 34 (FIGS. 4A and 4B) and the first shoulder 25 of the conductor 20 engages therewith to properly position the conductor 20 in the corresponding channel 30, 31.

In accordance with the present invention, the inner step 34 of at least one of the channels 30, 31 is arranged on a first inside surface thereof, while the inner step 34 of the remaining channels 30, 31 is arranged on an opposite second inside surface thereof. Thus, the Z-shaped conductors 20 are received in the channels 30 and are inverted with respect to each other. In other words, as illustrated in the preferred embodiment, the inner step 34 of the central channel 31 is located on a bottom surface thereof, while the inner steps 34 of the side channels 30 are located on a top surface thereof whereby the soldering section 24 of the conductor 20 received in the central channel 31 is located therebelow and the soldering section 24 of the conductors 20 received in the side channels 30 is located thereabove.

Figure 6:
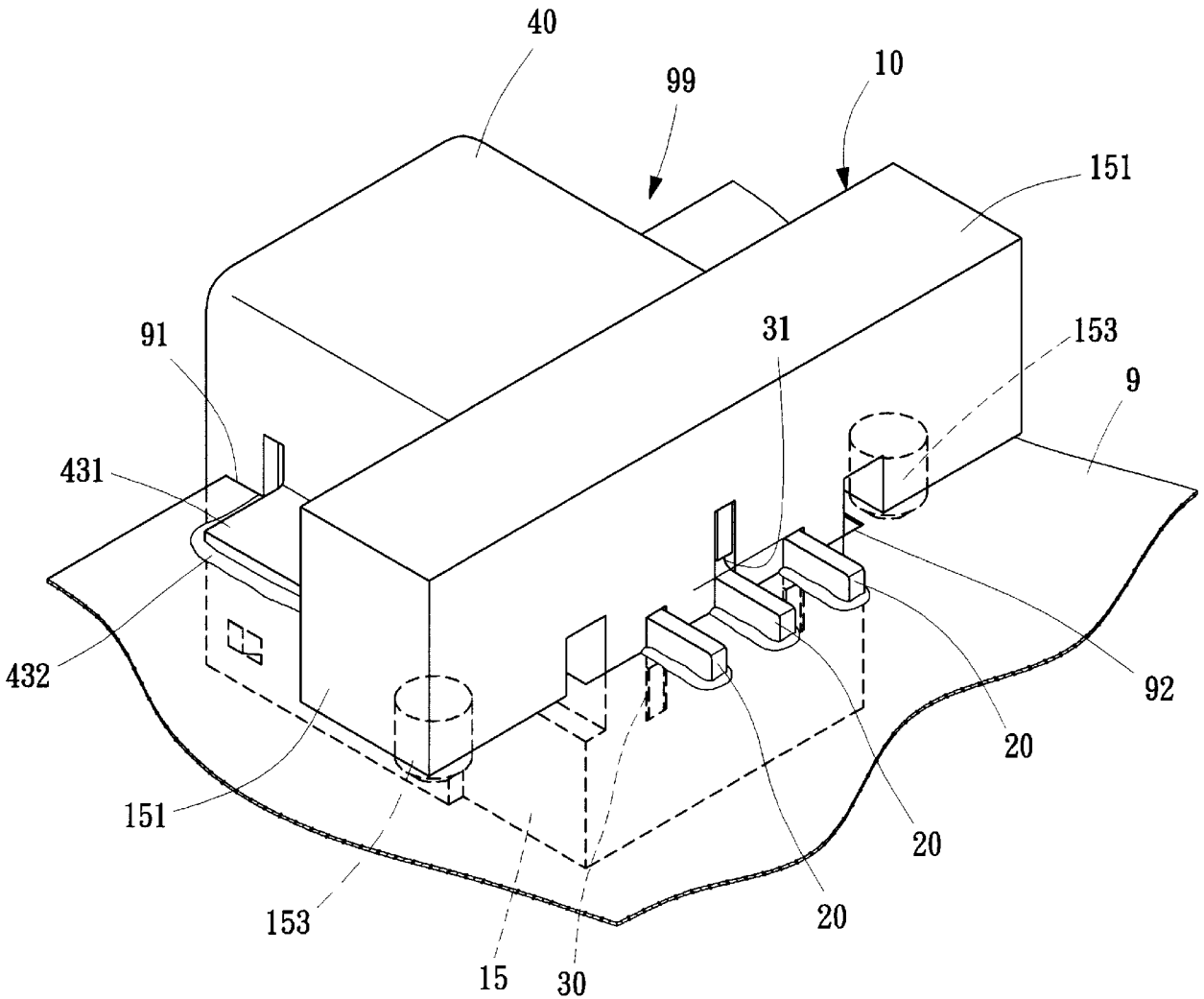
FIG. 6 is an assembled view of the electrical power connector of the present invention mounted to a circuit board.

By suitably dimensioning the channels 30 and the conductors 20, the soldering sections 24 of the conductors 20 are coplanar with each other thereby facilitating surface mounting to the circuit board 9, as shown in FIG. 6.

In accordance with the present invention, the circuit board 9 is provided with a cutout 91 into which the connector 99 is disposed whereby the rear face 14 of the connector 99 abuts against a rear edge 92 of the cutout 91 and the side wings 151 extend beyond side edges of the cutout 91 to be supported on the circuit board 9.

The conductors 20 are dimensioned so that the second shoulders 26 are substantially flush with the rear face 14 of the housing 10. Thus, abutting the rear face 14 of the housing 10 against the rear edge 92 of the cutout 91 of the circuit board 9 also abuts the second shoulders 26 of the conductors 20 against the rear edge 92 of the cutout 91. Thus, the conductors 20 are securely retained in the channels 30, 31.

Also referring to FIG. 2, preferably, a notch 27 is defined in the second shoulder 26 of each conductor 20 between the soldering section 24 and the connection section 23 in order to avoid interference with the rear edge 92 of the cutout 91 when the second shoulders 26 of the conductors 20 abut against the rear edge 92.

The engagement between the rear face 14 of the connector housing 10 and the rear edge of the cutout 91 allows the connector 99 to withstand a force caused by connecting/disconnecting the mating connector with the power connector 99.

The arrangement described above, namely having the soldering sections 24 of the Z-shaped conductors 20 substantially coplanar with the circuit board 9, promotes the reduction of height of the electrical power connector 99 above the circuit board 9 whereby a lower portion of the electrical power connector 99 is disposed below the circuit board 9.

Figure 5:
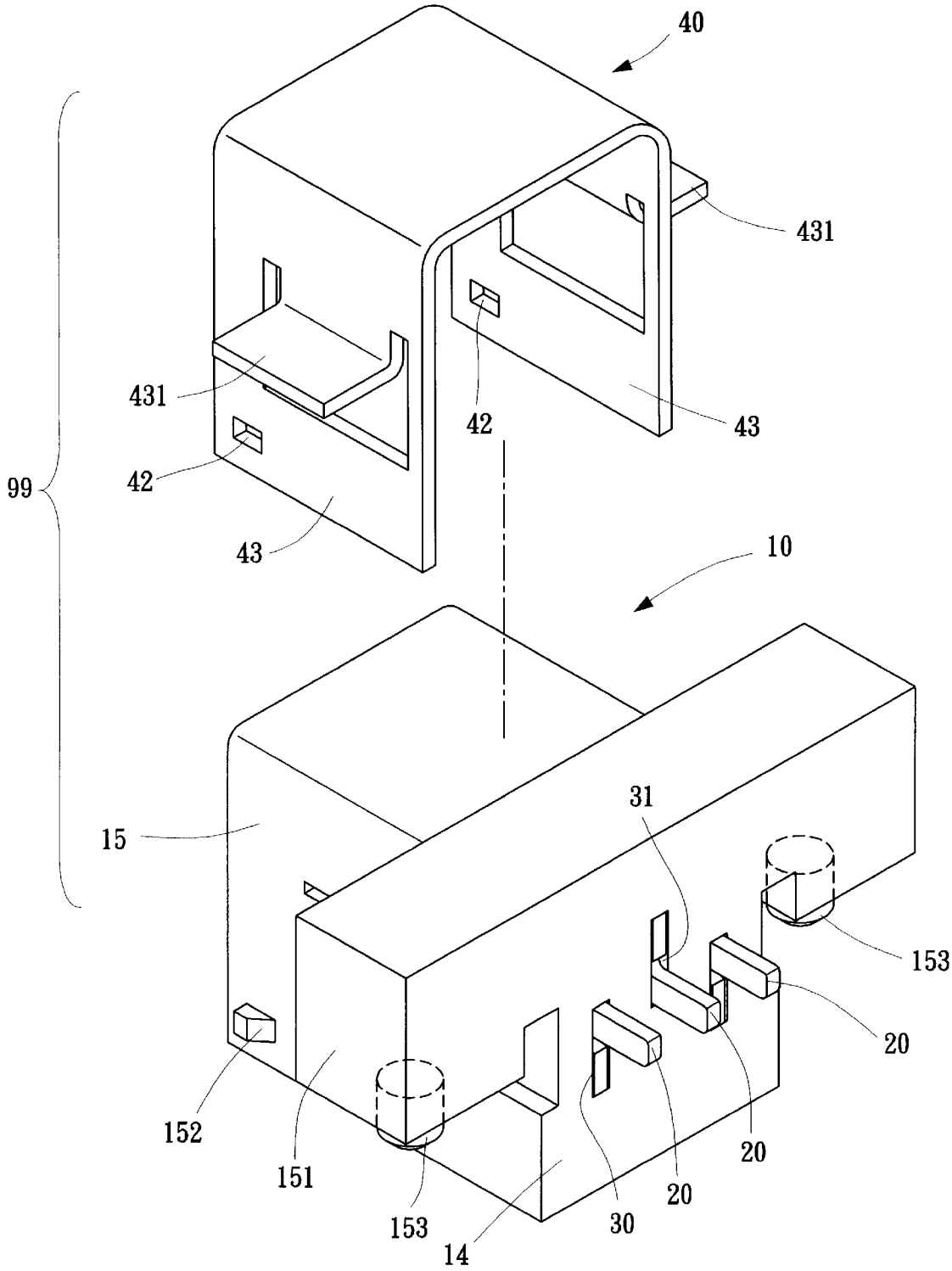
FIG. 5 is a perspective view of the electrical power connector of the present invention with the shield member detached therefrom.

In accordance with the present invention, as shown in FIG. 5, the electrical power connector 99 may selectively and additionally comprise a U-shaped metal shield member 40 fit over the housing 10. The shield member 40 has two side walls 43 each having an outer extension 431 arranged to be positioned on the circuit board 9 as shown in FIG. 6. Therefore, solder 432 may be applied thereto to fix the extensions 431 and thus the shield member 40 to the circuit board 9.

The side walls 43 of the shield member 40 each define at least one opening 42 engageable with corresponding side barbs 152 provided on side faces 15 of the housing 10. Thus, the shield member 40 is secured to the housing 10.

Although the present invention has been described with reference to the preferred embodiment thereof, it is apparent to those skilled in the art that there are a variety of modifications and changes that may be made without departing from the scope of the present invention, which is intended to be defined by the appended claims.

What is claimed is:

1. An electrical power connector comprising:

a nonconductive housing having a first face in which a receptacle chamber is formed and an opposite second face having a plurality of channels disposed therein, the channels communicating with the receptacle chamber; and a plurality of conductors received in the channels, the conductors each having a first section extending into the receptacle chamber and a second section extending beyond the second face of the housing, each of the conductors having a first shoulder engaging with a step formed in the corresponding channel, at least one of the conductors further having a second shoulder substantially flush with the second face of the housing;

wherein the second face of the housing is adapted to be supported against an edge of a substrate and the second sections of the conductors extend above and are supported on the substrate to be surface mounted thereto;

wherein the second shoulder of at least one of the conductors abuts against the edge of the substrate to secure the conductor in the corresponding channel.

2. The electrical power connector as claimed in claim 1, wherein the housing comprises two side wings extending above and supported on the substrate to further support the connector on the substrate.

3. The electrical power connector as claimed in claim 2, wherein each of the wings has a bottom face adapted to be supported on the substrate, the bottom face having a positioning post formed thereon and engageable with a corresponding hole defined in the substrate.

4. The electrical power connector as claimed in claim 1, wherein the channels are disposed in the second face above a bottom face of the housing with a lower portion of the housing between the channels and the bottom face positioned below the substrate.

5. The electrical power connector as claimed in claim 1, wherein the first section and second section of each conductor are substantially parallel to and offset with respect to each other, the first and second sections being connected by a connection section which is substantially normal to the first and second sections to form a Z-shaped configuration, the first and second shoulders being formed between the connection section and the second and first sections, respectively.

6. The electrical power connector as claimed in claim 1, wherein the second sections are arranged to be coplanar for facilitating surface mounting to the substrate.

7. The electrical power connector as claimed in claim 5, wherein the step of at least one of the channels is formed on a first inside surface thereof and the step of the remaining channels is formed on an opposite second inside face whereby the Z-shaped conductor that is received in the channel having the inner step formed on the first inside surface thereof is inverted with respect to the conductors received in the remaining channels.

8. The electrical power connector as claimed in claim 7, wherein the connection sections of the conductors are dimensioned such that the second sections of the conductors are substantially coplanar for being surface mounted to the substrate.

9. The electrical power connector as claimed in claim 1 further comprising a shield member fit over and mounted to the housing, the shield member comprising outer extensions adapted to be positioned on and surface mounted to the substrate.

10. The electrical power connector as claimed in claim 9, wherein the shield member comprises at least one opening engageable with a barb provided on the housing for securing the shield member to the housing.

11. An electrical power connector comprising:

a nonconductive housing having a first face in which a receptacle chamber is formed and an opposite second face in which at least one first channel and at least one second channel are disposed, the channels communicating with the receptacle chamber and having an inner step formed therein, the inner step of the first channel being formed on a first inside face thereof and the inner step of the second channel being formed on an opposite second inside face thereof; and a Z-shaped conductor received in each of the channels, the conductor having a first section and a second section substantially parallel to and offset from each other and connected by means of a connection section, the connection section forming a first shoulder with the second section and a second shoulder with the first section, the first shoulder engaging the inner step of the channel with the first section extending into the receptacle chamber whereby the conductors received in the first and second channels are inverted with respect to each other, the second shoulder being substantially flush with the second face of the housing with the second section extending beyond the second face of the housing;

wherein the second face of the housing is adapted to be supported against an edge of a substrate and the second sections of the conductors extend above and are supported on the substrate to be surface mounted thereto.

12. The electrical power connector as claimed in claim 11, wherein the housing comprises two side wings extending above and supported on the substrate.

13. The electrical power connector as claimed in claim 12, wherein the bottom face of the wings are distant from a bottom face of the housing whereby a lower portion of the housing is positioned below the substrate.

14. The electrical power connector as claimed in claim 11, wherein the housing defines one first channel and two second channels, the first channel being substantially centered between the second channels.

15. The electrical power connector as claimed in claim 11, wherein a notch is formed on the second shoulder of each conductor between the second section and the connection section.

* * * * *